US006837833B2

(12) United States Patent
Elledge

(10) Patent No.: US 6,837,833 B2
(45) Date of Patent: Jan. 4, 2005

(54) SPECIALTY WEIGHT TRAINING APPARATUS AND METHOD

(76) Inventor: Miles Elledge, 3544 Buena Vista Ave., Glendale, CA (US) 91208

( * ) Notice: Subject to any disclaimer, the term of this patent is extended or adjusted under 35 U.S.C. 154(b) by 292 days.

(21) Appl. No.: 10/265,063

(22) Filed: Oct. 3, 2002

(65) Prior Publication Data

US 2004/0067826 A1 Apr. 8, 2004

(51) Int. Cl.[7] ..... A63B 21/075

(52) U.S. Cl. ..... 482/108; 482/107; 482/110; 482/132

(58) Field of Search ..... 482/92, 93, 106–108, 482/132, 110; D21/681

(56) References Cited

U.S. PATENT DOCUMENTS

| | | | | | |
|---|---|---|---|---|---|
| 2,676,802 | A | * | 4/1954 | O'Brien | 482/106 |
| 2,920,418 | A | * | 1/1960 | Britt | 482/132 |
| 2,991,585 | A | | 7/1961 | Drees | |
| 3,403,906 | A | | 10/1968 | Burzenski | |
| 3,482,835 | A | * | 12/1969 | Dean | 482/108 |
| 3,550,312 | A | | 12/1970 | East | |
| 3,672,093 | A | | 6/1972 | Meek, Sr. | |
| 4,339,127 | A | | 7/1982 | Mitchell | |
| 4,880,229 | A | * | 11/1989 | Broussard | 482/108 |
| 4,900,017 | A | | 2/1990 | Bold, Jr. | |
| 5,033,740 | A | * | 7/1991 | Schwartz et al. | 482/105 |
| 5,040,787 | A | * | 8/1991 | Brotman | 482/106 |
| 5,259,824 | A | | 11/1993 | Cheltenham | |
| 5,464,379 | A | * | 11/1995 | Zarecky | 482/108 |
| 6,099,444 | A | | 8/2000 | Domenge | |
| 6,312,364 | B1 | | 11/2001 | Selsam | |

* cited by examiner

*Primary Examiner*—Justine R. Yu
*Assistant Examiner*—Victor Hwang
(74) *Attorney, Agent, or Firm*—Gene Scott, Patent Law & Venture Group

(57) ABSTRACT

A dumbbell type apparatus comprises a hand gripping surface mounted on an axle and engaging a pair of spaced apart circular wheel-weights rotationally engaged with the axle. The weights provide peripheral outfacing surfaces for rolling the apparatus on a floor surface. Each of the weights has a non-concentrically placed center of mass, whereby with the hand gripping surface held in one hand, the apparatus may be rotated causing the wheel-weights to spin and to thereby exercise the arm holding the apparatus.

2 Claims, 2 Drawing Sheets

SPECIALTY WEIGHT TRAINING APPARATUS AND METHOD

INCORPORATION BY REFERENCE

Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to free weights used for body building and more particularly to dynamic weight resistance training devices.

2. Description of Related Art

Dean, U.S. Pat. No. 3,482,835, teaches a dumbbell or barbell with generally conventional appearance and a means for manual gripping, provided however, with novel identical, uniformly rotatable, unbalanced weights. Exercise is achieved by anatomically resisting the centrifugal force resulting when the weights are caused to spin.

The following art defines the present state of this field:

Drees, U.S. Pat. No. 2,991,585 describes a handle member having a flat bearing surface at one end, a spindle projecting axially from said handle member medially of said bearing surface, a head at the outer end of said spindle, inner and outer arms each independently swingably mounted at its inner end portion upon the spindle for free rotational movement, the inner arm having its inner end portion seating upon said flat bearing surface and said outer arm having its outer surface of its inner end abutting the head of the spindle, said outer arm being mounted upon and abutting the adjacent face of the inner arm at the spindle, said arms being of substantially the same length and carrying at their outer extremities ball-like structures, each of said ball-like structures including portions projecting into the path of movement of the bail-like structure of the other arm, whereby said ball-like structures will abut when the arms are reversely rotated.

Burzenski, U.S. Pat. No. 3,403,906 describes an exercising device combination, the combination comprising a shaft, at least one wheel rotatably journaled to said shaft intermediate to the ends of said shaft, said at least one wheel having a nonabrasive outer rim, collar members fixedly attached to said shaft contacting the outermost portion of each of the opposed outer faces of said at least one wheel to maintain said at least one wheel in position intermediate the ends of said shaft, handle means spaced apart from said collar members, said handle means consisting of a pair of grip members coaxial with and slidably associated with the ends of said shaft to enable variation of the length of said shaft by axially sliding said grip members on said shaft, each of said grip members including spaced apart indentations for receiving the fingers of the user of said device when grasping said grip members, and spacer means inserted between said collars and the inner ends of said grip members and positioned around said shaft, whereby said wheel is rotated along a surface in response to force applied to said grip members providing various exercising positions for the user of said exercising device.

East, U.S. Pat. No. 3,550,312 describes an amusement and exercise apparatus comprising of an elongated handle portion having rotative end portions coupled to either end thereof which are rotatable about a common axis; ratchet-like camming means coupling said end portions to said handle portion, said camming means limiting rotation of said end portions to opposite directions; and pendulous means attached to each end portion whereby reciprocal motion of said handle portion in a single plane will cause said end portions and the respective pendulous means affixed thereto to rotate in opposite directions about said handle portion.

Meek, Sr., U.S. Pat. No. 3,672,093 describes a handheld weight swinging apparatus comprising of a frame handle from which there outwardly depends spaced apart shafts, with each shaft receiving the end of an arm in journaled relationship thereon. The free depending end of the arm is attached to a weight in the form of a ball so that when the frame is properly held in one's hand and manipulated, each of the balls may be pivotally swung about their respective shafts, with the direction of rotation being clockwise, counterclockwise, or in opposed direction with respect to one another, dependent upon the manner in which the handle is manipulated.

Mitchell, U.S. Pat. No. 4,339,127 describes a wheeled hand-held exercise device for strengthening the muscles of one's midsection. The device has at least two wheels mounted on an axle and has shafts connected to and extending both coaxial with and perpendicular to said axle.

Bold, Jr., U.S. Pat. No. 4,900,017 describes an inertial force, accommodating resistance exercise device and method. The subject device includes a nonrotating structure of enhanced mass and at least one wheel connected to the nonrotating structure to permit the device to be rolled to enable a user to perform accommodating resistance exercise. The mass of the nonrotating structure may be varied according to the requirements of the exercise by substituting inertial disks of different size and/or an inertial cradle or cage member. In exercises utilizing the instant invention resistance is accommodating indirect proportion to the speed with which the mass of the nonrotating structure is translated and direction in which it is translated.

Cheltenham, U.S. Pat. No. 5,259,824 describes a handheld, friction stabilized, multi-exercise device comprising a body having a substantially flat, wall frictionally gripping surface thereon, the surface facing laterally; and manually grippable handles carried by the body and projecting in longitudinally opposite directions at opposite sides of the body. Two such bodies, connected by a bar or bar assembly, may be employed during exercise Domenge, U.S. Pat. No. 6,099,444 describes an inertial exercise device that includes an internal hollow casing containing one or more spherical shaped weights for rolling and/or sliding movement within the hollow casing. The weights have an initial force imparted to them by a user of the exercise device. Once set in motion, the mass of the weights provide an inertia to the exercise by requiring the user to maintain the movement or work against the movement of the weights. Different types of motion can be imparted to the weights so as to provide exercise of varying difficulty and to provide exercise to different muscle groups.

Selsam, U.S. Pat. No. 6,312,364 describes a blow-moldable container, having a centrally located, generally tubular handle spanning a central recess has improved balance and ergonomics over existing blow-molded containers. Such a balanced container has great utility as a handheld freeweight, or as a container for pourable substances. An integrally molded base allows our container to be stood upright on end like a regular bottle. Products may be marketed in such containers under the premise that the consumer automatically acquires a freeweight by purchasing the product. The inclusion of fitably engageable contours on its top and bottom surfaces makes such a container stackable with others of its kind, for ease of packaging, shipping, and storage. A graduated set of handheld fillable freeweights may thus be compactly stored without a special rack. Since blow-molding offers great economy of production for sufficiently large numbers of containers, the average person will now be able to afford an entire graduated set of freeweights. Such freeweights may be shipped empty, and filled with water by the consumer, slashing shipping costs, and thereby further reducing the cost to the consumer. Blow-moldable, two-handed freeweights (barbells) are also disclosed. These also may be provided with contours offering enhanced stackability. Voids to fitably engage a user's feet further add to their utility. A deck member, as well as base members, may be stackably combined with the freeweights to form a stepping platform for aerobics, or an exercise bench. Methods for attaching fillable auxiliary weights to our handheld freeweights are also shown.

The prior art teaches devices having swinging pendulous masses such as balls, hand-held weight swinging toys, axle mounted wheel exercising devices, reciprocating weight exercise devices, gyroscopic exercisers, inertial exercise devices, exercise wheels of a wide variety of types, and water-filled free weights, but does not teach a dumbbell type of hand weight with off-center or unbalanced weighting for rotational exercising. The present invention fulfills these needs and provides further related advantages as described in the following summary.

SUMMARY OF THE INVENTION

The present invention teaches certain benefits in construction and use which give rise to the objectives described below.

A dumbbell type apparatus comprises a hand gripping surface mounted on an axle and engaging a pair of spaced apart circular wheel-weights rotationally engaged with the axle. The weights provide peripheral outfacing surfaces for rolling the apparatus on a floor surface. Each of the weights has a non-concentrically placed center of mass, whereby with the hand gripping surface held in one hand, the apparatus may be rotated causing the wheel-weights to spin and to thereby exercise the arm holding the apparatus.

A primary objective of the present invention is to provide an apparatus and method of use of such apparatus that provides advantages not taught by the prior art.

Another objective is to provide such an invention capable of using inertial forces to work out the arms, shoulder, abdominal and back muscles while in a standing or seated position.

A further objective is to provide such an invention capable of being rolled on a floor surface to workout the back and stomach muscles.

A further objective is to provide such an invention capable of providing muscle exercise and workout in a gravity-free environment.

A still further objective is to provide such an invention capable of adjusting the amount of offset mass so as to adjust the level of difficulty in using the invention.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
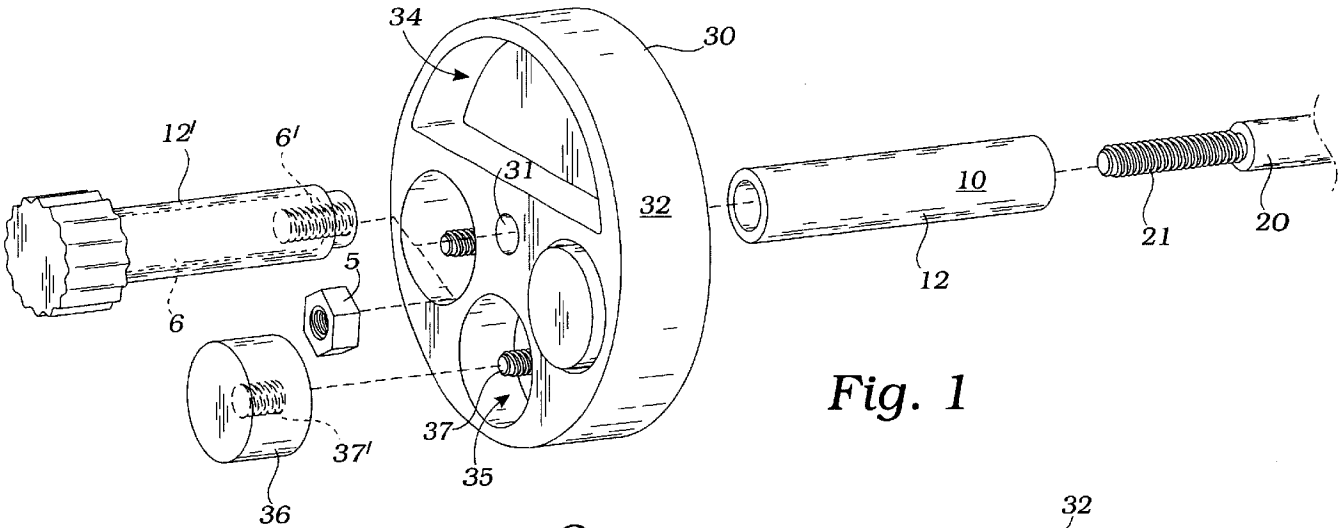
FIG. 1 is an exploded perspective view of the preferred embodiment of the invention showing a left side half, the right side half being a mirror image thereof with cavities arranged asymmetrically on a wheel-weight of the invention.

The present invention is a dumbbell type apparatus comprising a tube 12 having a hand gripping outer surface 10 mounted on an axle 20 which engages a pair of spaced apart circular wheel-weights 30. The weights are physically concentric and rotationally engaged with the axle 20. The axle 20 and weights 30 are preferably made of steel or other material with equivalent properties. The axle 20 has identical opposing threaded ends 21, only one of which is shown in FIG. 1. The hand gripping surface 10 is positioned between the wheel-weights 30 which provide peripheral outfacing surfaces 32 for rolling the apparatus on a supporting surface such as a floor or a carpet. Each of the wheel-weights 30 is mounted on the axle 20 with the threaded ends 21 inserted in central holes 31 and held in place by either nut 5, or outside handle 6 which provides an internal threaded hole 6'. Both of the wheel-weights 30 have a center of mass placed non-concentrically with the axle 20, whereby with the hand gripping surface 10 held in one hand, the apparatus may be moved in a circular manner in space causing the wheel-weights 30 to spin about the axle 20 and to thereby cause inertial forces to beneficially exercise the arm that holds the apparatus.

Figure 2:
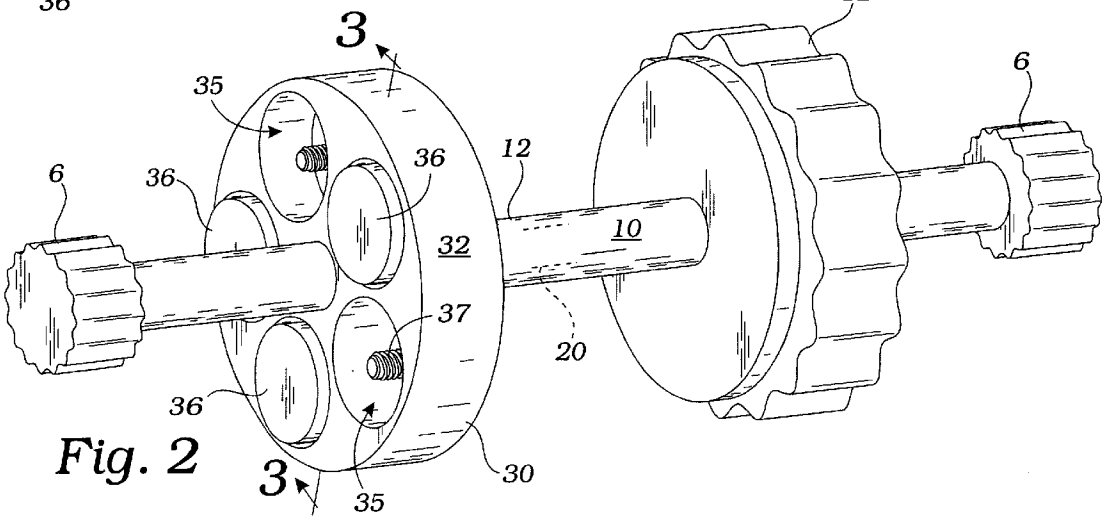
FIG. 2 is a perspective view of the invention as assembled with cavities arranged symmetrically on the wheel-weight of the invention.
Figure 3:
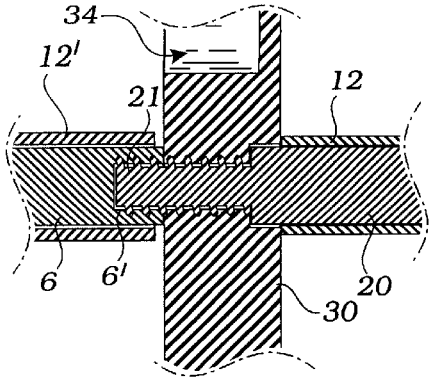
FIG. 3 is a partial sectional view thereof taken along line 3—3 in FIG. 2.
Figure 4:
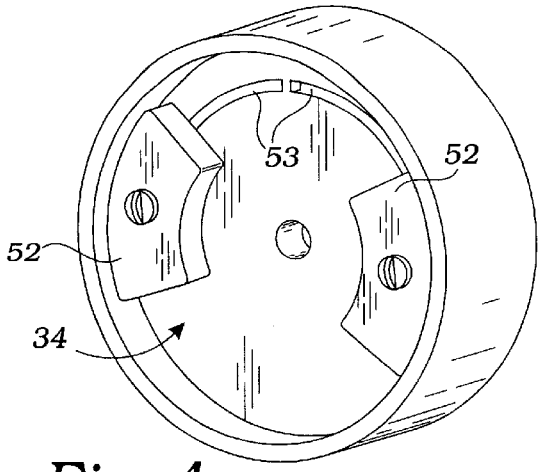
FIGS. 4 and 6 are views of one of the wheel-weights of the invention adapted for moving weight slugs of the invention to advantageous positions to provide offset mass to the wheel-weight.
Figure 6:
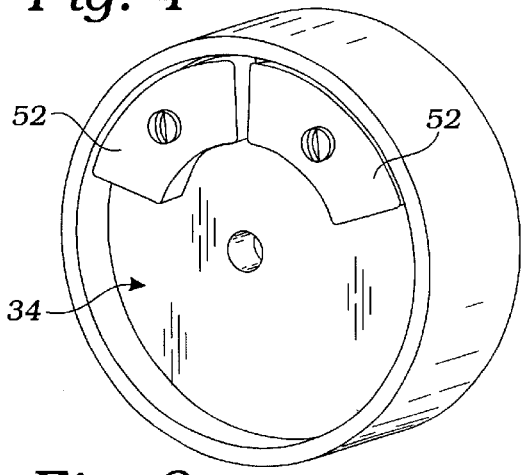
Figure 7:
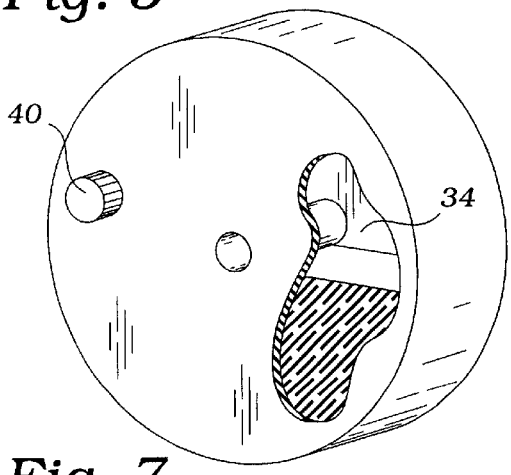
Figure 8:
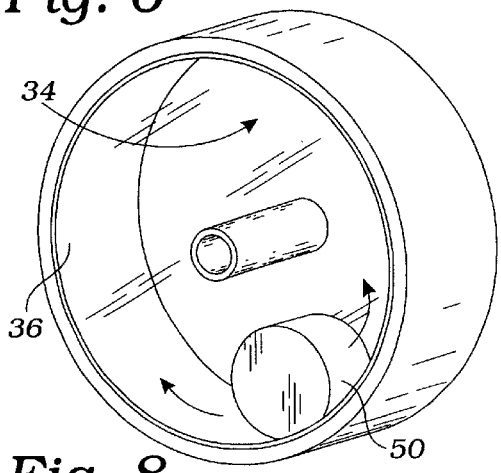
FIG. 8 is a view of one of the wheel-weights of the invention adapted with a cavity for receiving a rolling weight to provide spinning offset mass to the wheel-weight.

The wheel-weights 30 preferably each have one or more cavities 34, 35 formed in it and such cavities 34, 35 may be placed symmetrically relative to axle 20, as shown in FIGS. 2, 4 and 8, or non-symmetrically relative to axle 20, as shown in FIGS. 1, 5, 6, and 7. As is shown below and in the figures, the purpose of the cavities 34, 35 is to place the center of mass of the wheel-weights 30 off-center to provide an unbalanced mass causing the wheel-weights 30 to rotate about the axle 20. In this respect, the cavities 34, 35 may function to lighten one side or portion of the wheel-weights 30, or they may be filled with a heavy material to cause the cavity to be heavier than the opposing portions of the wheel-weights 30.

In the preferred embodiment shown in FIG. 2, the wheel-weights 30 each have a plurality of cavities 35 formed in them and placed symmetrically about axle 20. A plurality of weight slugs 36 are mated with the cavities 35 using a means for engaging the weight slugs 36 such as the threaded stud 37 and threaded hole 37' as shown in FIG. 1. Thus, in this embodiment, one or more of the weight slugs 36 may be placed into wheel-weights 30 to provide more or less offset mass.

In a further embodiment, shown in FIGS. 4 and 6, two position adjustable weight slug 52 are mounted within the cavity 34. FIG. 4 shows a means for positioning the weight slug 52 so as to enable adjustment of the amount of the offset mass. In FIG. 4, the slugs 52 are set in opposing positions so that the offset mass is set to zero. In FIG. 6, the slugs 52 (shown as more massive than in FIG. 4) are set to one side of wheel-weight 30 so as to cause the offset mass to be significant. Bolts 52' are used to fix the slugs 52 at selected locations relative to circular slots 53.

Figure 5:
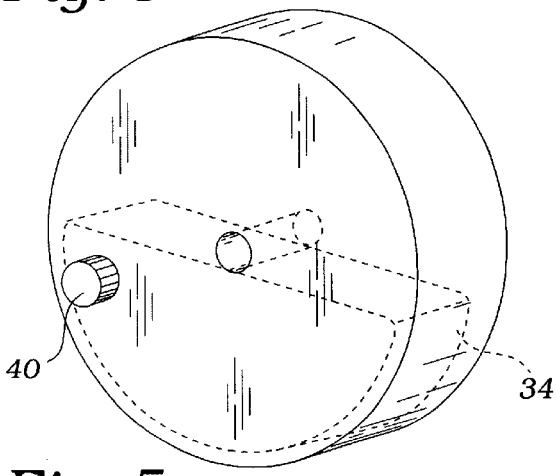
FIGS. 5 and 7 are views of one of the wheel-weights of the invention adapted with a cavity for receiving a weighting material to provide offset mass to the wheel-weight.

In another embodiment, a means for filling 40 the one or more cavities 34 with a weighting material such as water, sand or lead shot, for instance, is provided. The filling means 40 may be a capped aperture shown in FIGS. 5 and 7. In FIGS. 5 and 7, the cavity 34 is a closed space, while, it should be noticed that in FIGS. 1–4 and 6, the cavities 34 and 35 are open to one side of wheel-weights 30.

In a further embodiment, shown in FIG. 8, the cavity 34 provides an interior circular surface 36, the apparatus further providing a disc-shaped weight 50 within the cavity 34 and in contact with the interior circular surface 36 for freely rolling thereon within the wheel-weights 30. In this embodiment, the wheel-weights 30 are fixed, non-rotationally, to the axle 20.

The outside handles 6 are engaged collinearly with the axle 20 and positioned laterally relative to the wheel-weights 30. The attachment method is clearly shown in FIG. 3, a sectional view, in part, taken along line 3—3 in FIG. 2. Hand grip tubes 12' are placed over handles 6 so that the apparatus may be rotated while gripping the tubes 12' fixedly. This enablement provides a means for resting upper body weight on the handles 6 and, while resting on the knees, rolling the apparatus away and toward the knees while lowering and raising the trunk to work-out various trunk muscles including those of the back and of the stomach areas.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A dumbbell type apparatus comprising: a hand gripping surface mounted on an axle; the axle further engaging a pair of spaced apart circular wheel-weights rotationally engaged with the axle and physically concentric therewith, the hand gripping surface positioned therebetween; the wheel-weights providing peripheral outfacing surfaces for rolling the apparatus on a supporting surface; each of the wheel-weights providing a plurality of cavities placed in positions lateral to the axle; and a plurality of weight slugs adapted for being threadedly engaged within the plurality of cavities; whereby with the hand gripping surface held in one hand, the apparatus may be rotated in space causing the wheel-weights to spin and to thereby exercise the arm holding the apparatus.

2. The apparatus of claim 1 further comprising a pair of handles engaged collinearly with the axle and positioned laterally relative to the wheel-weights.

* * * * *